US009358801B2

(12) United States Patent
Kimura

(10) Patent No.: US 9,358,801 B2
(45) Date of Patent: Jun. 7, 2016

(54) LIQUID SUPPLY DEVICE

(71) Applicant: CANON KABUSHIKI KAISHA, Tokyo (JP)

(72) Inventor: Koji Kimura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/480,282

(22) Filed: Sep. 8, 2014

(65) Prior Publication Data

US 2015/0097881 A1 Apr. 9, 2015

(30) Foreign Application Priority Data

Oct. 9, 2013 (JP) ..... 2013-211976

(51) Int. Cl.
*B41J 29/38* (2006.01)
*B41J 2/175* (2006.01)

(52) U.S. Cl.
CPC ..... *B41J 2/17596* (2013.01); *B41J 2/175* (2013.01)

(58) Field of Classification Search
CPC .... B41J 2/175; B41J 2/17566; B41J 2/17503; B41J 2/17506; B41J 2/17576; B41J 2/17596; B41J 2/19
USPC ..... 347/5–7, 84–86, 92
See application file for complete search history.

(56) References Cited

U.S. PATENT DOCUMENTS

| | | | | |
|---|---|---|---|---|
| 6,224,198 | B1 * | 5/2001 | Cook et al. | 347/85 |
| 2010/0182370 | A1 * | 7/2010 | Nemoto et al. | 347/30 |
| 2010/0231620 | A1 | 9/2010 | Shinada | 347/6 |
| 2010/0231621 | A1 * | 9/2010 | Watanabe et al. | 347/7 |
| 2010/0238240 | A1 * | 9/2010 | Yokouchi et al. | 347/85 |

FOREIGN PATENT DOCUMENTS

| | | | |
|---|---|---|---|
| JP | 2010-143050 | | 7/2010 |
| JP | 2010143050 A | * | 7/2010 |
| JP | 2010-214721 | | 9/2010 |
| JP | 2010214721 A | * | 9/2010 |

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

A liquid supply device includes a first container storing liquid; a second container to which the liquid is supplied from the first container; at least one flow path to connect the first and second containers; a valve in the flow path to allow or interrupt the flow of the liquid in the flow path by opening or closing the valve; a pump provided to the flow path to transfer the liquid from the first container to the second container; and a control unit to operate the pump under a state in which the valve is opened to transfer the liquid in the first container to the second container, then close the valve and stop the pump, and then open the valve under a state in which the pump is stopped to transfer the liquid in the second container to the first container.

13 Claims, 7 Drawing Sheets

LIQUID SUPPLY DEVICE

BACKGROUND OF THE INVENTION

1. Field of the Invention

The present invention relates to a liquid supply device capable of stirring liquid stored in a liquid tank.

2. Description of the Related Art

In recent years, in an ink jet recording apparatus as one type of liquid ejection apparatus, pigment ink excellent in weather resistance has been mainly used. However, when the pigment ink is left unused in an ink tank for a long period of time, pigment settles on a bottom portion of the ink tank. Therefore, concentration and viscosity of the pigment ink become non-uniform due to fluctuation thereof depending on the position inside the ink tank. When the pigment ink in this state is supplied to an ink jet recording head in order to perform recording, the following problems occur. A jetting characteristic of the ink may fluctuate for each recording. Further, due to the ink having high concentration and high viscosity, a narrow portion of the ink jet recording head, such as an ink flow path portion, a filter portion, and a nozzle, may be clogged, and in the worst case, ejection failure may occur. Still further, due to the nonuniformity of the concentration of the ink, recording quality may become nonuniform. Therefore, it is essential to keep uniform concentration and viscosity of the ink in the ink tank. To keep uniform concentration of the ink before use, it is necessary to take measures such as shaking the tank and stirring the ink in the tank. Further, a period of time to elapse until the concentration and the viscosity of the pigment ink fluctuate and become nonuniform differs depending on colors, and hence it is important to stir the ink.

In view of this, in Japanese Patent Application Laid-Open No. 2010-143050, the ink in the ink tank, which is configured to store the ink, is stirred in such a manner that the ink is caused to flow backward into the ink tank from a sub tank, which is configured to temporarily store the ink supplied from the ink tank and transport the ink to a recording head. Specifically, a bellows is provided so as to communicate to the sub tank, and a valve is provided on a flow path connecting the ink tank and the sub tank to each other. The sub tank is pressurized by the bellows under a state in which the valve is closed. After that, the valve is opened, and the ink in the sub tank flows backward into the ink tank due to a pressure difference therebetween. In this manner, the ink in the ink tank is stirred.

Further, in Japanese Patent Application Laid-Open No. 2010-214721, two flow paths each connecting the ink tank and the sub tank to each other are provided. The ink is circulated through the two flow paths. In this manner, the ink in the ink tank is stirred.

However, in the case of the method disclosed in Japanese Patent Application Laid-Open No. 2010-143050, only an amount of the ink, which corresponds to a deformation volume of the bellows, flows backward into the ink tank, and hence the amount of the ink that flows into the ink tank is small. Therefore, the amount of the ink that flows into the ink tank cannot be increased unless the ink is repeatedly caused to flow backward from the sub tank into the ink tank. Thus, a longer period of time is required for a stirring operation for the ink. Further, when dealing with the above-mentioned problem by providing a larger bellows, the bellows is required to have a volume equivalent to that of the ink tank. Thus, the device is upsized.

Further, in the case of Japanese Patent Application Laid-Open No. 2010-214721, liquid cannot be caused to forcefully flow from the sub tank into the ink tank, and hence a longer period of time is required to stir the ink.

SUMMARY OF THE INVENTION

The present invention is directed to providing a liquid supply device capable of efficiently stirring liquid stored in a liquid tank.

According to one aspect of the present invention, there is provided a liquid supply device, including: a first container in which liquid is stored; a second container to which the liquid is supplied from the first container; at least one flow path configured to connect the first container and the second container to each other; a valve provided on the flow path and configured to allow or to interrupt the flow of the liquid in the flow path by opening or closing the valve; a pump provided to the flow path and configured to cause the liquid to be transferred from the first container to the second container; and a control unit configured to operate the pump under a state in which the valve is opened so as to cause the liquid in the first container to be transferred to the second container, then close the valve and stop the pump, and then open the valve under a state in which the pump is stopped so as to cause the liquid in the second container to be transferred to the first container.

Further, according to another aspect of the present invention, there is provided a method of stirring liquid for a liquid supply device, the liquid supply device including: a first container in which the liquid is stored; a second container to which the liquid is supplied from the first container; and a flow path for connecting the first container and the second container to each other, the method of stirring liquid including: a first step of decreasing a pressure in the first container, and transferring a predetermined amount of the liquid from the first container to the second container through the flow path; a second step of closing the flow path, in which, when the predetermined amount of the liquid is transferred from the first container to the second container, the flow path is closed and the transferring of the liquid from the first container to the second container is suspended; and a third step of opening the flow path under a state in which the pressure in the first container is decreased so as to cause the liquid in the second container to be transferred to the first container.

Further features of the present invention will become apparent from the following description of exemplary embodiments with reference to the attached drawings.

DESCRIPTION OF THE EMBODIMENTS

Now, embodiments of the present invention are described in detail with reference to the attached drawings. It is to be noted that in the attached drawings, components having the same function are denoted by the same reference symbols, and description thereof is omitted in some cases.

First Embodiment

Figure 1:
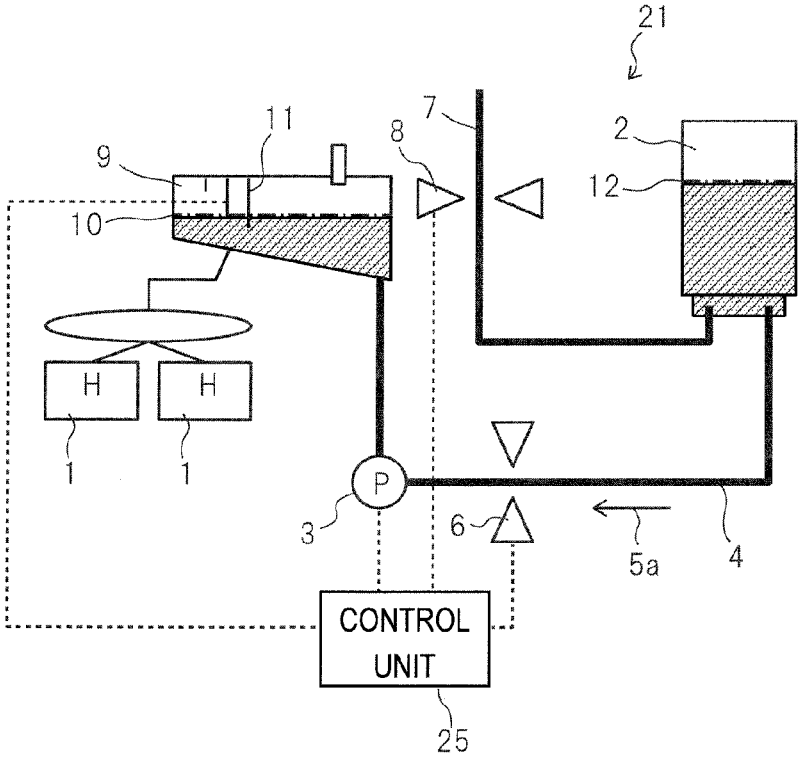
FIG. 1 is a schematic structural view of a liquid supply device according to a first embodiment of the present invention, for illustrating an initial state before liquid for stirring is caused to flow out.

A liquid supply device according to a first embodiment of the present invention is described with reference to FIGS. 1 to 9. FIG. 1 is a schematic structural view of the liquid supply device according to the first embodiment, for illustrating an initial state before liquid for stirring is caused to flow out. A liquid supply device 21 of the present invention is used in a recording apparatus for performing recording by ejecting liquid or the like. A case where the liquid supply device 21 is used in the recording apparatus for ejecting liquid from liquid ejection heads 1 is described below.

The liquid supply device of this embodiment includes a replaceable liquid tank 2 (first container) for storing liquid such as ink containing pigment, and a sub tank 9 (second container) for temporarily storing the liquid stored in the liquid tank 2.

When supplying liquid from the liquid tank 2 to the sub tank 9, in order to maintain a pressure in the liquid tank 2 at the atmospheric pressure, an atmosphere communicating path 7 communicating to the atmosphere is connected to a bottom surface of the liquid tank 2. Further, an atmosphere valve 8 configured to open and close the atmosphere communicating path 7 through its opening and closing operation is provided on the atmosphere communicating path 7.

The sub tank 9 is connected to the liquid ejection heads 1 each configured to eject liquid onto a recording medium such as paper so as to record characters, images, or the like, and the liquid is supplied from the sub tank 9 to the liquid ejection heads 1. Further, when supplying the liquid from the sub tank 9 to the liquid ejection heads 1, in order to maintain a pressure in the sub tank 9 at the atmospheric pressure, the sub tank 9 communicates to the atmosphere. In order to store the liquid in the sub tank 9 up to a liquid level that can stabilize a liquid ejection characteristic of the liquid ejection heads 1, a specified liquid amount for optimally maintaining a difference in hydraulic head of liquid between the sub tank 9 and the liquid ejection heads 1 is set in the sub tank 9. A level of a liquid surface of the liquid is normally maintained at an optimum liquid level 10 indicated by the alternate long and short dash line.

The bottom surface of the liquid tank 2 and a bottom surface of the sub tank 9 are connected to each other through a supply flow path 4 (first flow path) so that liquid may flow (i.e., transfer) between the liquid tank 2 and the sub tank 9. Both ends of the supply flow path 4 are respectively connected to the bottom surface of the liquid tank 2 and the bottom surface of the sub tank 9 so as to prevent air bubbles from being mixed into the flowing liquid.

A pump 3 is provided in the middle of the supply flow path 4. The pump 3 is configured to generate a pressure for causing the liquid to flow from the liquid tank 2 to the sub tank 9 in a direction indicated by the arrow 5*a*. Further, a first control valve 6 is provided on the supply flow path 4. The first control valve 6 is configured to open and close the supply flow path 4 through its opening and closing operation. That is, the first control valve 6 may allow the passage of the liquid or interrupt the flow of the liquid.

Operations of the first control valve 6, the atmosphere valve 8, and the pump 3 are controlled by a control unit 25. It is to be noted that when the liquid supply device 21 of the present invention is applied to, for example, the recording apparatus, the control unit 25 may also control liquid ejecting operations of the liquid ejection heads 1.

A liquid amount sensor 11 serving as a detection unit for detecting a liquid level of the liquid is provided in the sub tank 9. The liquid amount sensor 11 is electrically connected to the control unit 25 so as to output the detection result to the control unit 25.

When the liquid is consumed in the liquid ejection heads 1, the liquid level of the liquid in the sub tank 9 is lowered. When the liquid amount sensor 11 detects that the liquid level is lowered, the control unit 25 opens the first control valve 6 and operates the pump 3 so as to supply the liquid from the liquid tank 2 to the sub tank 9. In this manner, the liquid level of the liquid in the sub tank 9 is maintained at the optimum liquid level 10 that is the specified liquid amount.

It is to be noted that a first liquid level 12 of the liquid tank 2, which is indicated by the alternate long and short dash line, is a liquid level of the liquid in the initial state. Further, the amount of the liquid in the liquid tank 2 can be detected by a remaining amount detection sensor (not shown) provided in the liquid tank 2, or can be detected based on the amount of the liquid, which is consumed in the liquid ejection heads 1.

Figure 2:
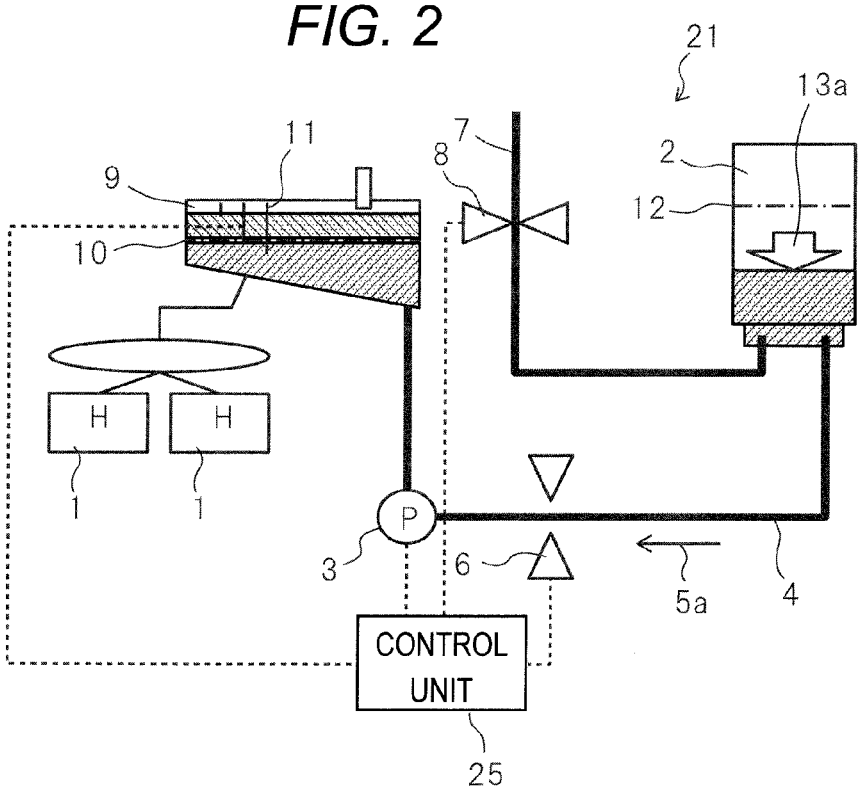
FIG. 2 is a schematic view illustrating a state in which the liquid is caused to flow out from a liquid tank.

FIG. 2 is a schematic view illustrating a state in which the liquid is caused to flow out from the liquid tank 2. First, the atmosphere valve 8 on the atmosphere communicating path 7 is closed so as to interrupt the flow of air in the atmosphere into the liquid tank 2. Then, the first control valve 6 on the supply flow path 4 is opened and the pump 3 is operated so as to cause the liquid to flow from the liquid tank 2 into the sub tank 9. At this time, along with the flow of the liquid out from the liquid tank 2, the liquid level of the liquid in the liquid tank 2 is lowered from the first liquid level 12 in a direction indicated by the arrow 13*a*. On the other hand, the liquid flows into the sub tank 9 above the optimum liquid level 10 indicating the specified liquid amount.

Figure 3:
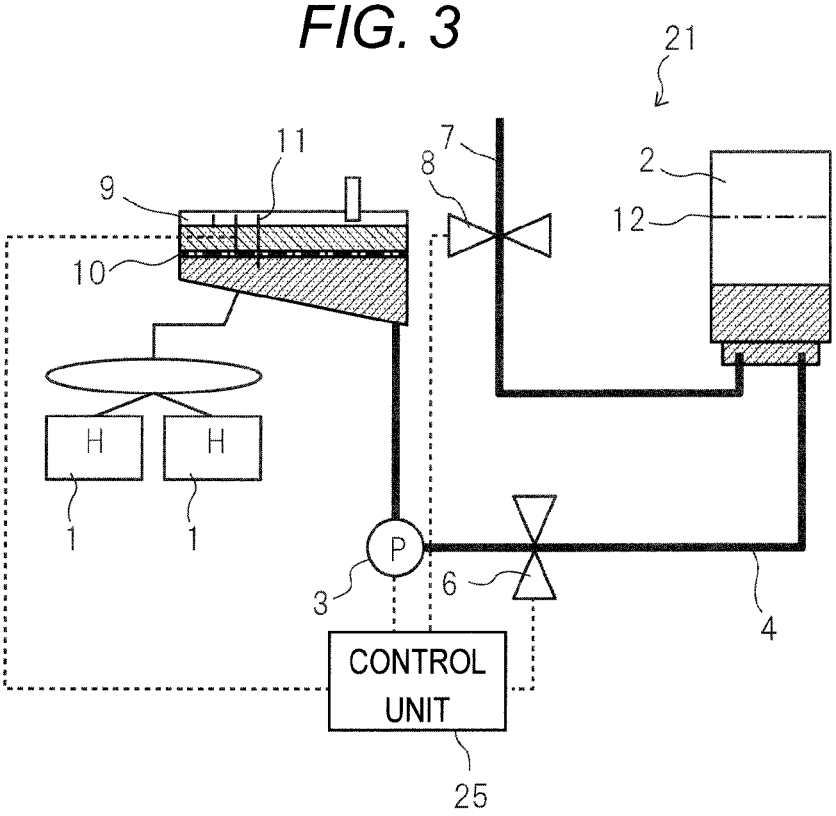
FIG. 3 is a schematic view illustrating a state in which a pump is stopped.

FIG. 3 is a schematic view illustrating a state in which the pump 3 is stopped. The liquid flows into the sub tank 9 above the optimum liquid level 10 indicating the specified liquid amount. When the liquid amount sensor 11 detects that the liquid level of the liquid reaches a liquid level corresponding to a predetermined excess liquid amount, the pump 3 is stopped to suspend the supply of the liquid, and at the same time, the first control valve 6 is closed. At this time, the pressure in the liquid tank 2 is maintained in a state of being decreased as compared to the atmospheric pressure. On the other hand, the liquid level of the liquid in the sub tank 9 is maintained at a liquid level that is equal to or more than the specified liquid amount (optimum liquid level 10). Further, the sub tank 9 communicates to the atmosphere, and hence the pressure in the sub tank 9 is equal to the atmospheric pressure. It is to be noted that the amount of the liquid caused to flow from the liquid tank 2 into the sub tank 9 may be appropriately set, and the liquid amount sensor 11 may be configured to detect that a predetermined amount of the liquid flows into the sub tank 9.

Figure 4:
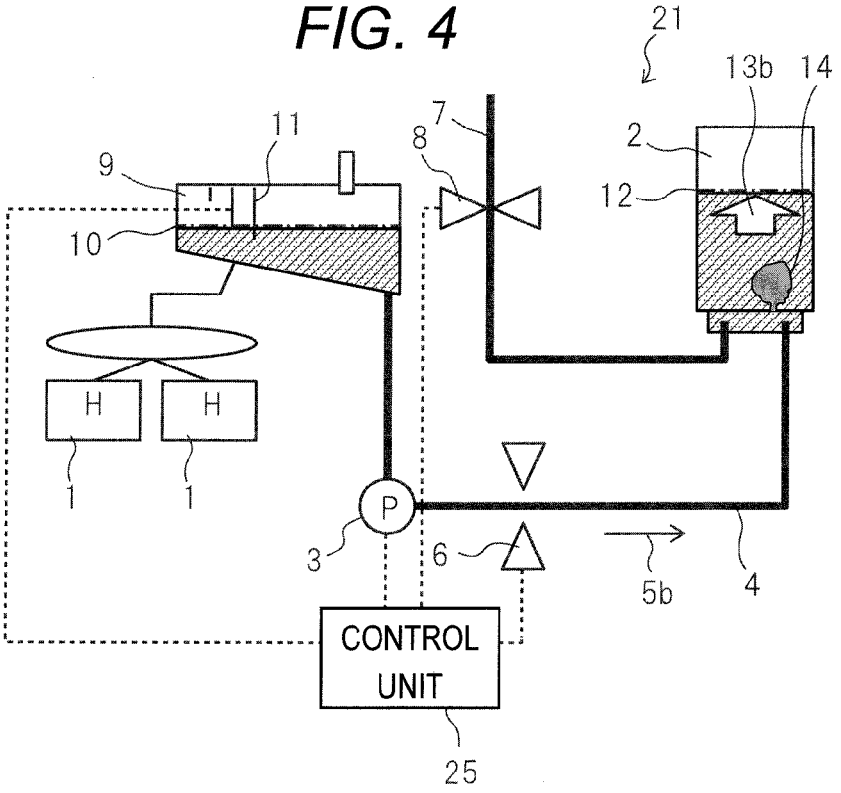
FIG. 4 is a schematic view illustrating a state in which the liquid is caused to flow backward from a sub tank into the liquid tank.
Figure 5:
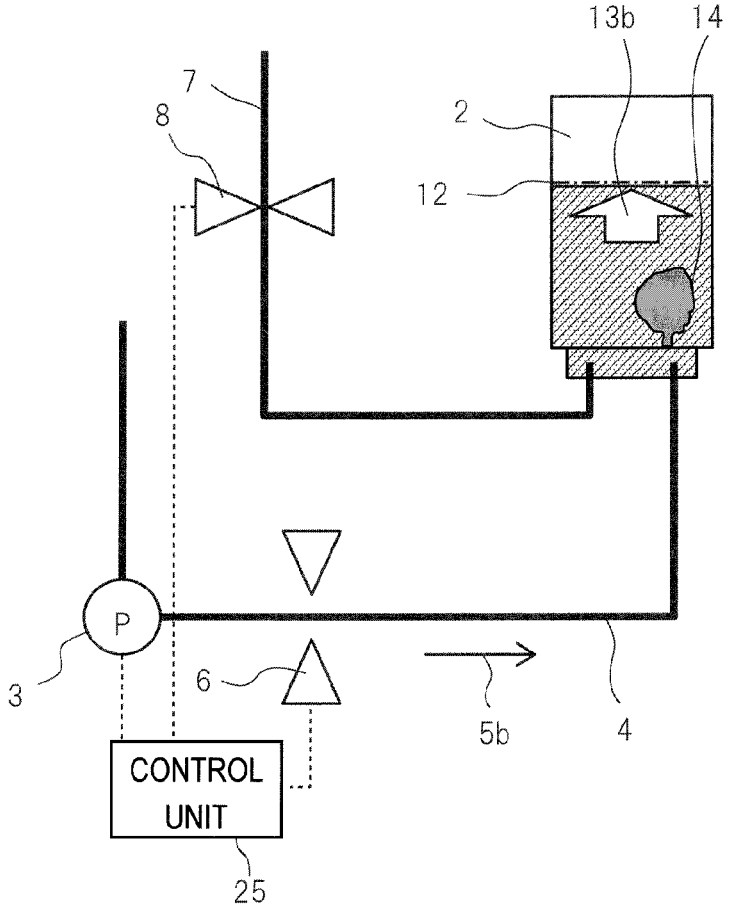
FIG. 5 is a schematic view illustrating a principle of stirring the liquid in the liquid tank.

FIG. 4 is a schematic view illustrating a state in which the liquid is caused to flow backward from the sub tank 9 into the liquid tank 2. When the first control valve 6 is instantaneously opened, the pressure in the liquid tank 2 is to be increased until reaching the atmospheric pressure from the state of being decreased as compared to the atmospheric pressure. Therefore, the liquid flows from the sub tank 9 through the supply flow path 4 in a direction indicated by the arrow 5*b*. That is, the liquid flows backward. At this time, back-flow liquid 14 flows backward into the liquid tank 2. With the back-flow liquid 14, the liquid in the liquid tank 2 is stirred, and the liquid level of the liquid returns in a direction indicated by the arrow 13*b* up to the first liquid level 12 in the initial state. It is to be noted that in the figures, the liquid in the liquid tank 2 and the back-flow liquid 14 are illustrated in different patterns from each other for the purpose of easier understanding of a state in which the back-flow liquid 14 flows backward into the liquid tank 2, but the liquid in the liquid tank 2 and the back-flow liquid 14 are the same liquid. A large amount of the back-flow liquid 14 is caused to flow backward into the liquid tank 2 at a higher flow rate so as to eliminate the difference between the pressure in the liquid tank 2 and the atmospheric pressure. On the other hand, in the sub tank 9, an amount of the liquid above the optimum liquid level 10 indicating the specified liquid amount flows out, and the liquid level of the liquid in the sub tank 9 returns to the optimum liquid level 10 in the initial state. It is to be noted that it may also be reconfirmed by the liquid amount sensor 11 that the liquid level of the liquid in the sub tank 9 returns to the optimum liquid level 10.

Now, a principle of stirring the liquid is described again with reference to FIG. 5. The atmosphere valve 8 on the atmosphere communicating path 7 is closed so as to interrupt the flow of air in the atmosphere into the liquid tank 2. The first control valve 6 is opened and then the pump 3 is operated so as to cause the liquid to flow out from the liquid tank 2. Thus, the pressure in the liquid tank 2 is brought into the state of being decreased as compared to the atmospheric pressure. Then, the first control valve 6 is closed and then instantaneously opened. Thus, the pressure in the liquid tank 2 is to be increased until reaching the atmospheric pressure from the state of being decreased as compared to the atmospheric pressure. Therefore, the liquid that has flowed out from the liquid tank 2 flows through the supply flow path 4 in the direction indicated by the arrow 5*b*. At this time, the liquid flows backward into the liquid tank 2 until the liquid level returns in the direction indicated by the arrow 13*b* up to the first liquid level 12. The pressure in the liquid tank 2 is to be increased up to the atmospheric pressure, and hence the back-flow liquid 14 flows into the liquid tank 2 at the higher flow rate to stir the liquid in the liquid tank 2. Thus, the liquid level of the liquid returns to the first liquid level 12. In this manner, the liquid in the liquid tank 2 can be stirred.

In the liquid supply device 21 of this embodiment, an arbitrary amount of the liquid can be caused to flow backward into the liquid tank 2. Further, the liquid can be caused to flow into the liquid tank 2 at the higher flow rate. Thus, the liquid in the liquid tank 2 can be stirred efficiently in a short period of time.

Next, referring to FIGS. 6 to 9, a case where the remaining amount of the liquid in the liquid tank 2 is different from that in the above-mentioned example (see FIGS. 1 to 4) is described. Specifically, a case where the liquid in the liquid tank 2 is decreased and the liquid level of the liquid is lowered from the first liquid level 12 to a second liquid level 15 is described.

Figure 6:
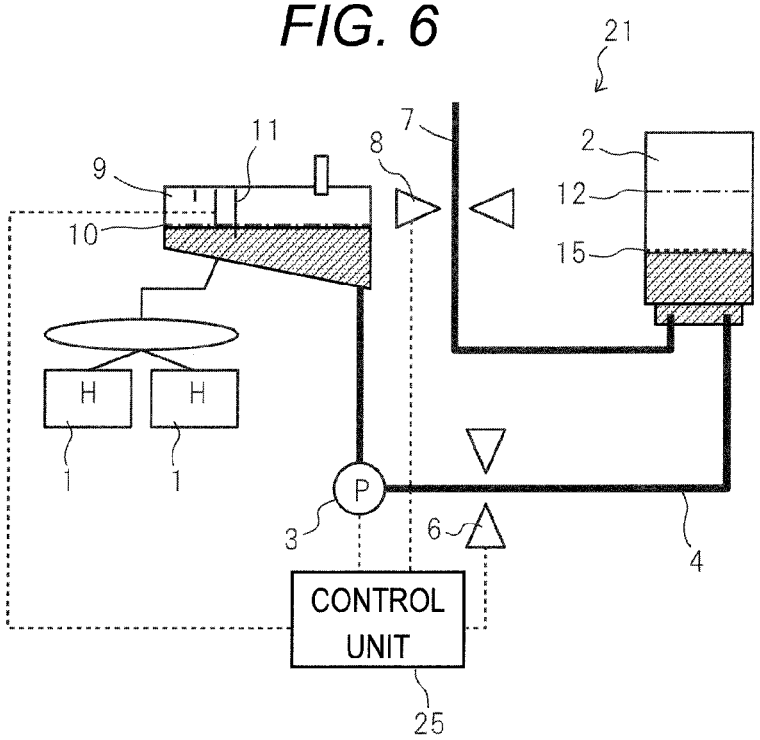
FIG. 6 is a schematic view of another example, for illustrating an initial state before the liquid for stirring is caused to flow out.

FIG. 6 illustrates an initial state before the liquid for stirring is caused to flow out. In this example, the liquid level of the liquid stored in the liquid tank 2 reaches the second liquid level that is lower than the first liquid level 12.

Figure 7:
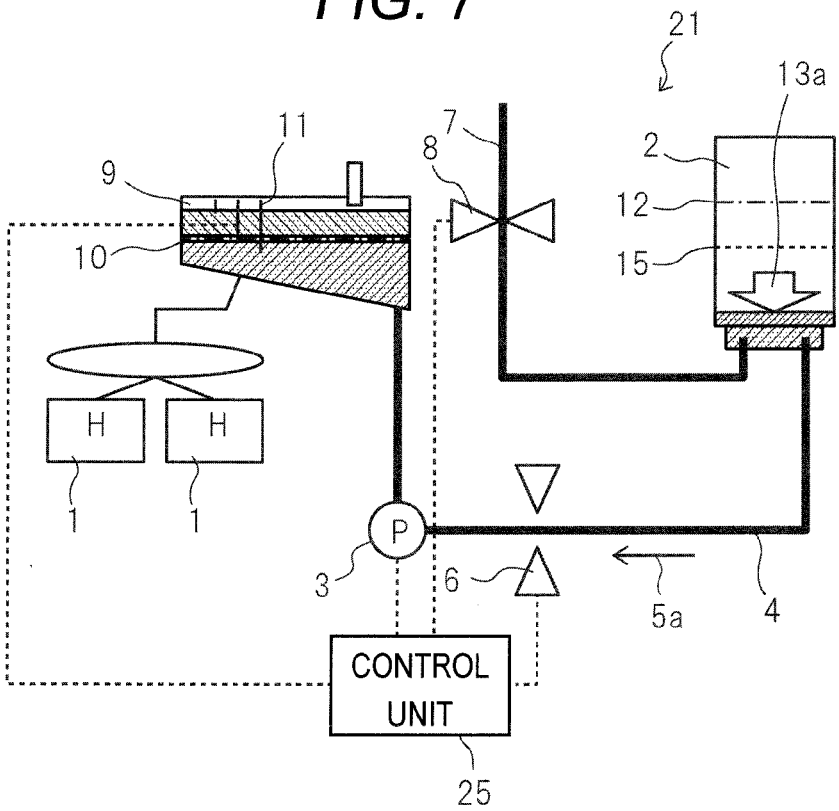
FIG. 7 is a schematic view illustrating a state in which the liquid is caused to flow out from the liquid tank.

FIG. 7 is a schematic view illustrating a state in which the liquid is caused to flow out from the liquid tank 2. The atmosphere valve 8 on the atmosphere communicating path 7 is closed so as to interrupt the flow of air in the atmosphere into the liquid tank 2. The first control valve 6 on the supply flow path 4 is opened and the pump 3 is operated so as to cause the liquid to flow from the liquid tank 2 into the sub tank 9 in the direction indicated by the arrow 5*a*. At this time, the liquid level of the liquid in the liquid tank 2 is lowered from the second liquid level 15 in the direction indicated by the arrow 13*a*. On the other hand, the liquid flows into the sub tank 9 above the optimum liquid level 10 indicating the specified liquid amount.

Figure 8:
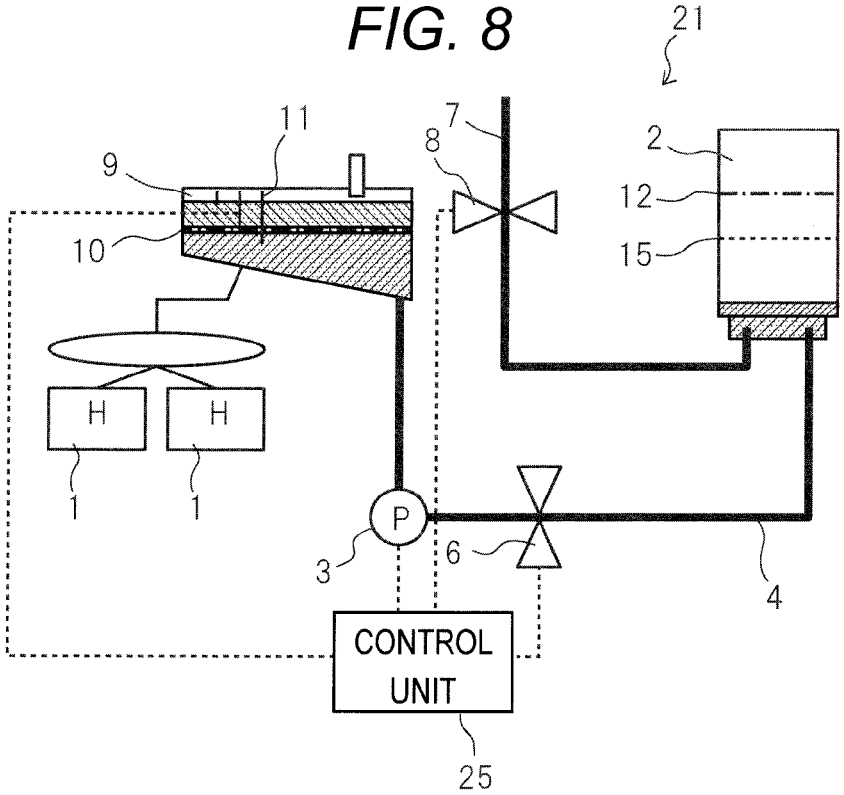
FIG. 8 is a schematic view illustrating a state in which the pump is stopped.

FIG. 8 is a schematic view illustrating a state in which the pump 3 is stopped. The liquid flows into the sub tank 9 above the optimum liquid level 10 indicating the specified liquid amount. When the liquid amount sensor 11 detects that the liquid level of the liquid reaches a liquid level corresponding to a predetermined excess liquid amount, the pump 3 is stopped to suspend the supply of the liquid, and at the same time, the first control valve 6 is closed. At this time, the pressure in the liquid tank 2 is maintained in a state of being decreased as compared to the atmospheric pressure. On the other hand, the liquid level of the liquid in the sub tank 9 is maintained at a liquid level that is equal to or more than the specified liquid amount (optimum liquid level 10). The sub tank 9 communicates to the atmosphere, and hence the pressure in the sub tank 9 is equal to the atmospheric pressure.

Figure 9:
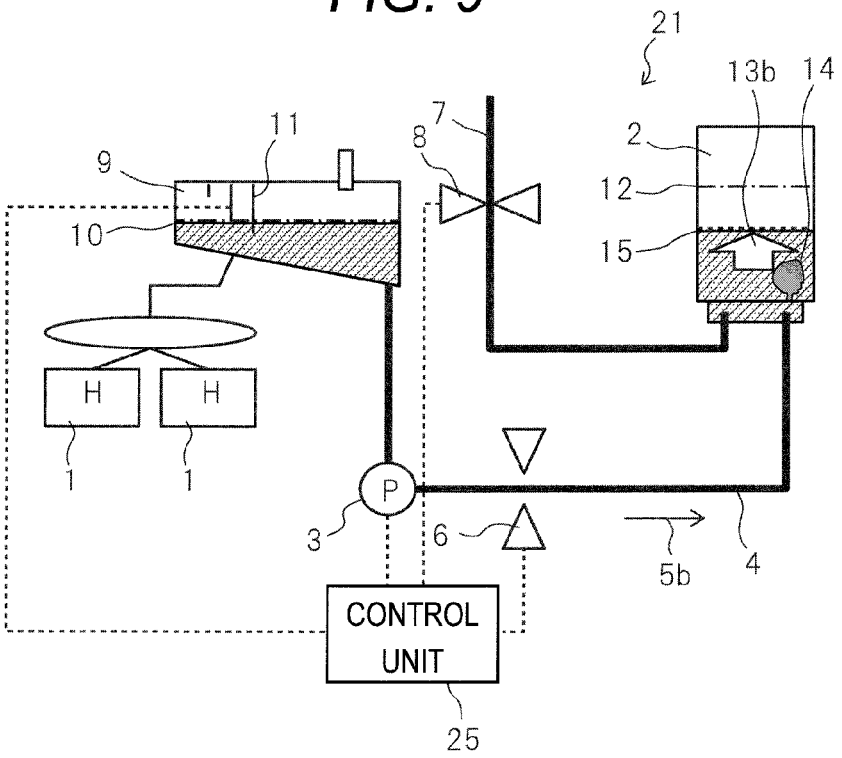
FIG. 9 is a schematic view illustrating a state in which the liquid is caused to flow backward from the sub tank into the liquid tank.

FIG. 9 is a schematic view illustrating a state in which the liquid is caused to flow backward from the sub tank 9 into the liquid tank 2. When the first control valve 6 is then instantaneously opened, the pressure in the liquid tank 2 is to be increased until reaching the atmospheric pressure from the state of being decreased as compared to the atmospheric pressure. Therefore, the liquid flows from the sub tank 9 through the supply flow path 4 in the direction indicated by the arrow 5*b*. At this time, the back-flow liquid 14 flows backward into the liquid tank 2. With the back-flow liquid 14, the liquid in the liquid tank 2 is stirred, and the liquid level of the liquid returns in the direction indicated by the arrow 13*b* up to the second liquid level 15 in the initial state. On the other hand, in the sub tank 9, an amount of the liquid above the optimum liquid level 10 indicating the specified liquid amount flows out, and the liquid level of the liquid in the sub tank 9 returns to the optimum liquid level 10 in the initial state. It is to be noted that it may also be reconfirmed by the liquid amount sensor 11 that the liquid level of the liquid in the sub tank 9 returns to the optimum liquid level 10 in the initial state of FIG. 6.

As described above, in the liquid supply device 21 of the present invention, the liquid in the liquid tank 2 can be stirred irrespective of the amount of the liquid in the liquid tank 2.

For example, in an ink jet recording apparatus as one type of the recording apparatus, it is indispensable to provide ink tanks (liquid tanks 2) for respective ink types of several colors for multicolor recording, and the ink consumption amounts of the respective colors are different from one another. However, even in a case where the remaining amounts of the inks in the plurality of ink tanks are different from one another, such as a case where the remaining amount of the liquid in the liquid tank 2 is larger as illustrated in FIG. 1 and a case where the remaining amount of the liquid in the liquid tank 2 is smaller as illustrated in FIG. 6, the ink in the ink tank can be stirred.

Further, a time measurement unit may be provided in the liquid supply device. The time measurement unit may be configured to measure an elapsed time in a state in which the liquid in the liquid tank 2 is not decreased (that is, is not changed), and after a predetermined period of time elapses, the stirring operation may be performed. Further, a timing for performing the stirring operation may be changed depending on the type of the liquid.

Second Embodiment

Figure 10:
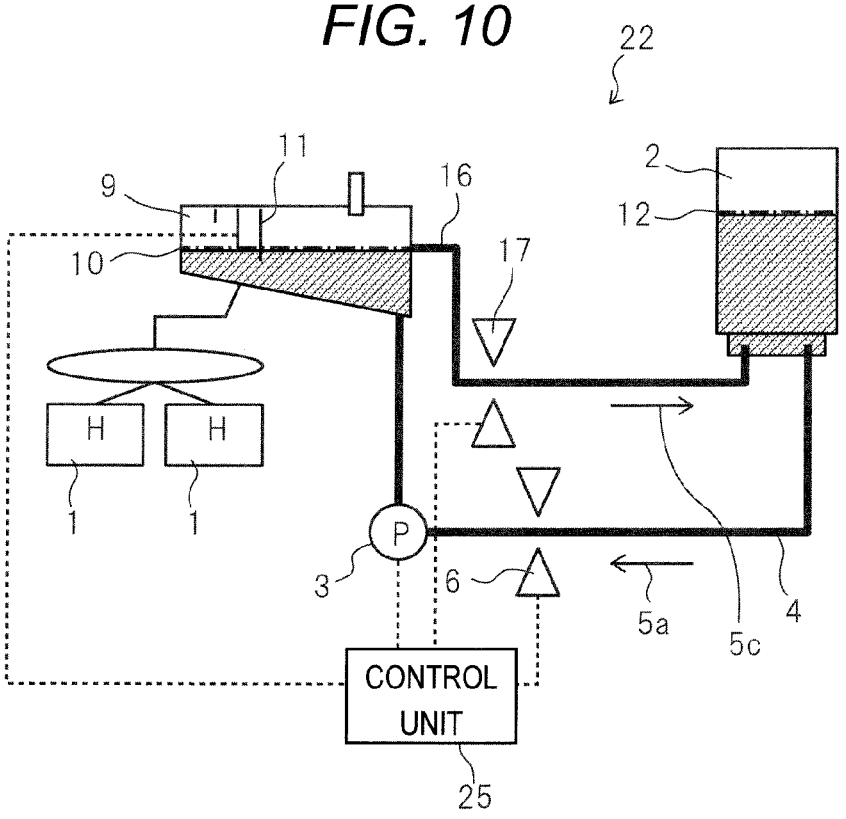
FIG. 10 is a schematic structural view of a liquid supply device according to a second embodiment of the present invention, for illustrating an initial state before the liquid for stirring is caused to flow out.

A liquid supply device according to a second embodiment of the present invention is described with reference to FIGS. 10 to 14. It is to be noted that description of the same components as those of the first embodiment is omitted herein. FIG. 10 is a schematic structural view of a liquid supply device 22 according to the second embodiment, for illustrating an initial state before the liquid for stirring is caused to flow out. It is to be noted that in the liquid in the sub tank 9 of FIGS. 11 and 12, a part above the optimum liquid level 10 and a part below the optimum liquid level 10 are indicated by different hatchings.

In this embodiment, the sub tank 9 and the liquid tank 2 are connected to each other through a supply return path 16 (second flow path). The supply return path 16 is provided so as to return an amount of the liquid, which exceeds the specified liquid amount, to the liquid tank 2 when the liquid is excessively supplied to the sub tank 9. One end of the supply return path 16 is connected to a part of a side surface of the sub tank 9, which is at the same level as the optimum liquid level 10 being a level of the liquid surface of the liquid in the sub tank 9. The other end of the supply return path 16 is connected to the bottom surface of the liquid tank 2. That is, in this embodiment, the atmosphere communicating path 7, through which the liquid tank 2 directly communicates to the atmosphere, is not provided unlike the first embodiment, and in this embodiment, the liquid tank 2 communicates to the atmosphere through the supply return path 16 and the sub tank 9. Further, the liquid having a liquid level higher than the optimum liquid level 10, that is, the liquid, which is excessively supplied, flows from the sub tank 9 through the supply return path 16 toward the liquid tank 2 in a direction indicated by the arrow 5*c* in an overflow manner. Then, the liquid returns to the liquid tank 2 to be stored therein again. As described above, the liquid supply device 22 having a circulating system of circulating the liquid between the liquid tank 2 and the sub tank 9 is constructed. A second control valve 17 configured to open and close the supply return path 16 through its opening and closing operation is provided on the supply return path 16.

In this embodiment, the operations of the first control valve 6, the second control valve 17, and the pump 3 are controlled by the control unit 25.

In the initial state, the liquid level of the liquid in the sub tank 9 is the optimum liquid level 10, and the liquid level of the liquid in the liquid tank 2 is the first liquid level 12.

Figure 11:
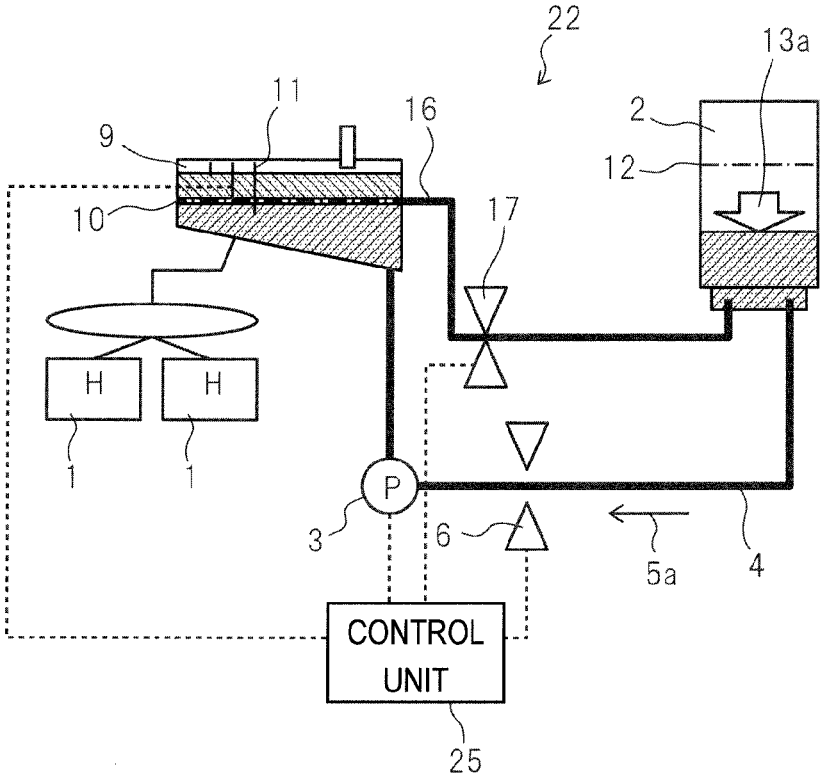
FIG. 11 is a schematic view illustrating a state in which the liquid is caused to flow out from the liquid tank.

FIG. 11 is a schematic view illustrating a state in which the liquid is caused to flow out from the liquid tank 2. First, the second control valve 17 on the supply return path 16 is closed so as to interrupt the flow of air in the atmosphere and the liquid into the liquid tank 2. The first control valve 6 on the supply flow path 4 is opened and the pump 3 is operated so as to cause the liquid to flow from the liquid tank 2 into the sub tank 9. At this time, the liquid level of the liquid in the liquid tank 2 is lowered from the first liquid level 12 in the direction indicated by the arrow 13*a*. On the other hand, in the sub tank 9, the liquid excessively supplied from the liquid tank 2 is not discharged into the supply return path 16, and the liquid flows into the sub tank 9 above the optimum liquid level 10 indicating the specified liquid amount.

Figure 12:
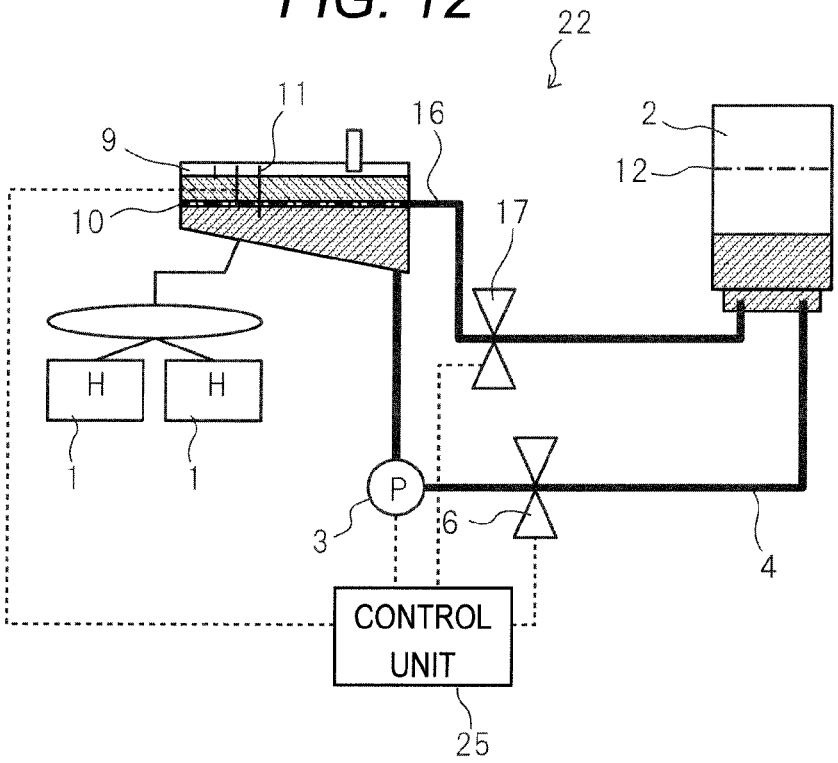
FIG. 12 is a schematic view illustrating a state in which the pump is stopped.

FIG. 12 is a schematic view illustrating a state in which the pump 3 is stopped. The liquid flows into the sub tank 9 above the optimum liquid level 10 indicating the specified liquid amount. When the liquid amount sensor 11 detects that the liquid level of the liquid reaches a liquid level corresponding to a predetermined excess liquid amount, the pump 3 is stopped to suspend the supply of the liquid, and at the same time, the first control valve 6 is closed. At this time, the pressure in the liquid tank 2 is maintained in a state of being decreased as compared to the atmospheric pressure. On the other hand, the liquid level of the liquid in the sub tank 9 is maintained at a liquid level that is equal to or more than the specified liquid amount (optimum liquid level 10). The sub tank 9 communicates to the atmosphere, and hence the pressure in the sub tank 9 is equal to the atmospheric pressure.

Figure 13:
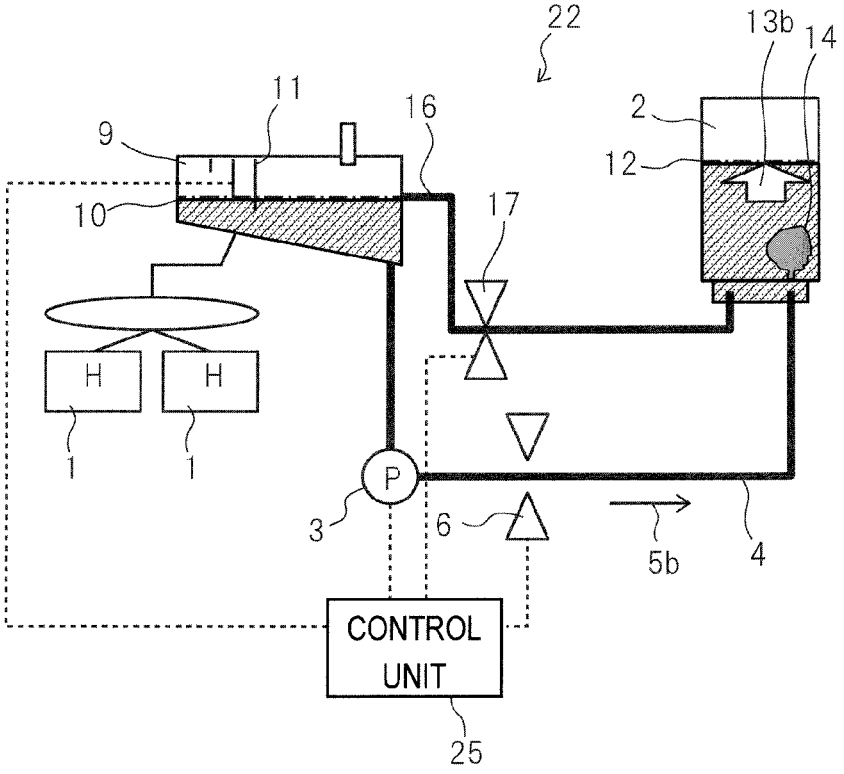
FIG. 13 is a schematic view illustrating a state in which the liquid is caused to flow backward from the sub tank into the liquid tank through a supply flow path.

FIG. 13 is a schematic view illustrating a state in which the liquid is caused to flow backward from the sub tank 9 into the liquid tank 2 through the supply flow path 4. When the first control valve 6 is then instantaneously opened, the pressure in the liquid tank 2 is to be increased until reaching the atmospheric pressure from the state of being decreased as compared to the atmospheric pressure. Therefore, the liquid flows from the sub tank 9 through the supply flow path 4 in the direction indicated by the arrow 5*b*. At this time, the back-flow liquid 14 flows into the liquid tank 2 until the liquid level of the liquid in the liquid tank 2 reaches the first liquid level 12. At that time, with the back-flow liquid 14, the liquid in the liquid tank 2 is stirred. On the other hand, in the sub tank 9, an amount of the liquid above the optimum liquid level 10 indicating the specified liquid amount flows out, and the liquid level of the liquid returns to the optimum liquid level 10 in the initial state. It is to be noted that it may also be reconfirmed by the liquid amount sensor 11 that the liquid level of the liquid in the sub tank 9 returns to the optimum liquid level 10 in the initial state of FIG. 10.

Figure 14:
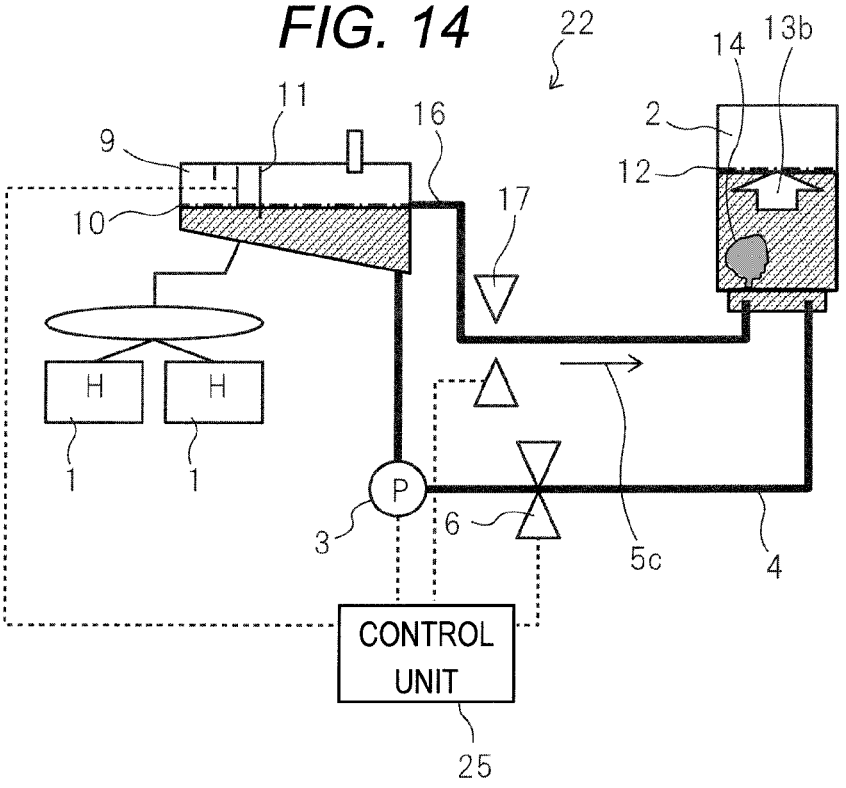
FIG. 14 is a schematic view illustrating a state in which the liquid is caused to flow backward from the sub tank into the liquid tank through a supply return path.

FIG. 14 is a schematic view illustrating a state in which the liquid is caused to flow backward from the sub tank 9 into the liquid tank 2 through the supply return path 16. In this embodiment, the liquid can be caused to flow backward into the liquid tank 2 not through the supply flow path 4 but through the supply return path 16. Specifically, as in the above description, after the liquid is caused to flow from the liquid tank 2 into the sub tank 9, the pump 3 is stopped, and at the same time, the first control valve 6 is closed. When the second control valve is then instantaneously opened, the pressure in the liquid tank 2 is to be increased until reaching the atmospheric pressure from the state of being decreased as compared to the atmospheric pressure. Therefore, the liquid flows from the sub tank 9 through the supply return path 16 toward the liquid tank 2 in the direction indicated by the arrow 5*c*. At this time, the back-flow liquid 14 flows into the liquid tank 2 until the liquid level of the liquid in the liquid tank 2 reaches the first liquid level 12. At that time, with the back-flow liquid 14, the liquid in the liquid tank 2 is stirred. On the other hand, in the sub tank 9, an amount of the liquid above the optimum liquid level 10 indicating the specified liquid amount flows out, and the liquid level of the liquid returns to the optimum liquid level 10 in the initial state. It is to be noted that only the amount of the liquid above the optimum liquid level 10 of the sub tank 9 flows from the sub tank 9 into the liquid tank 2, and hence the air bubbles are not mixed into the liquid tank 2.

Also in the liquid supply device 22 of this embodiment, similarly to the first embodiment, an arbitrary amount of the liquid can be caused to flow backward into the liquid tank 2. Further, the liquid can be caused to flow into the liquid tank 2 at the higher flow rate. Thus, the liquid in the liquid tank 2 can be stirred efficiently in a short period of time. Further, the liquid in the liquid tank 2 can be stirred irrespective of the amount of the liquid in the liquid tank 2.

It is to be noted that in the liquid supply device 22 of this embodiment, when the liquid is to be caused to flow into the liquid tank 2 so as to stir the liquid in the liquid tank 2, a path to be used can be selected from the supply flow path 4 and the supply return path 16, and hence the liquid can be stirred with balance even in the liquid tank 2 having a wider bottom surface.

According to the present invention, the arbitrary amount of the liquid can be caused to flow into the first container at the higher flow rate. Therefore, the liquid in the first container can be stirred in a short period of time.

According to the present invention, the liquid stored in the first container can be stirred easily and efficiently.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-211976, filed Oct. 9, 2013, which is hereby incorporated by reference herein in its entirety.

What is claimed is:

1. A liquid supply device, comprising:

a first container in which liquid is stored;

a second container to which the liquid is supplied from the first container;

a flow path configured to connect the first container by one end of the flow path and to connect the second container by the other end of the flow path;

a valve provided on the flow path and configured to switchably operate between an opened state in which the liquid is allowed to flow in the flow path and a closed state in which the liquid is not allowed to flow in the flow path;

a pump provided on the flow path and configured to cause the liquid to be transferred from the first container to the second container; and a control unit configured to operate the pump under a state in which the valve is in the opened state so as to cause the liquid in the first container to be transferred to the second container, then switch the valve from the opened state to the closed state and stop the pump, under a pressure decreased state in which the pressure in the first container is decreased by the pump, and then switch the valve from the closed state to the opened state under the pressure decreased state while the pump is stopped so as to cause liquid in the second container to be transferred to the first container.

2. The liquid supply device according to claim 1, further comprising:

an atmosphere communicating path provided to the first container, for communicating an inside of the first container and an atmosphere to each other; and an atmosphere valve provided on the atmosphere communicating path, for opening and closing the atmosphere communicating path, wherein the control unit is configured to operate the pump under a state in which the atmosphere valve is closed.

3. The liquid supply device according to claim 2, wherein the second container has an atmosphere communicating port for communicating an inside of the second container and the atmosphere to each other.

4. The liquid supply device according to claim 2, wherein the one end of the flow path is connected to a bottom surface of the first container.

5. The liquid supply device according to claim 1, wherein the flow path comprises a first flow path and a second flow path, wherein the valve comprises a first valve provided on the first flow path and a second valve provided on the second flow path, wherein the pump is provided on the first flow path, and wherein the control unit is configured to operate the pump under a state in which only the first valve of the first flow path is in the opened state so as to cause the liquid in the first container to be transferred to the second container, then switch the first valve of the first flow path from the opened state to the closed state and stop the pump, under a pressure decreased state in which the pressure in the first container is decreased by the pump, and then switch the first valve of the first flow path or the second valve of the second flow path from the closed state to the opened state under the pressure decreased state while the pump is stopped so as to cause the liquid in the second container to be transferred to the first container.

6. The liquid supply device according to claim 5, wherein the second container has an atmosphere communicating port for communicating the inside of the second container and the atmosphere to each other, and wherein the first container communicates to the atmosphere through the second flow path, the second container, and the atmosphere communicating port.

7. The liquid supply device according to claim 5, wherein the second flow path is connected to a position in a side surface of the second container, which corresponds to a level of a liquid surface of a predetermined amount of the liquid stored in the second container.

8. The liquid supply device according to claim 5, wherein the first flow path and the second flow path are connected to a bottom surface of the first container.

9. The liquid supply device according to claim 1, further comprising a head connected to the second container, for ejecting the liquid supplied from the second container to outside.

10. The liquid supply device according to claim 1, wherein at least one of the first container or the second container comprises a sensor configured to detect an amount of the liquid.

11. The liquid supply device according to claim 10, wherein the sensor is provided in the first container, and wherein the liquid supply device further comprises a measurement unit configured to measure a period of time in which the amount of the liquid, which is detected by the sensor, is kept unchanged.

12. A method of stirring liquid for a liquid supply device, the liquid supply device comprising: a first container in which the liquid is stored; a second container to which the liquid is supplied from the first container through a flow path connected to the first container by one end of the flow path and connected to the second container by the other end of the flow path; and a valve and a pump provided on the flow path, the method of stirring liquid comprising:

a first step of decreasing a pressure in the first container and transferring a predetermined amount of the liquid from the first container to the second container through the flow path by the pump;

a second step after the first step of switching the valve on the flow path from an opened state in which the liquid is allowed to flow in the flow path to a closed state in which the liquid is not allowed to flow in the flow path, after the predetermined amount of the liquid is transferred from the first container to the second container, under a pressure decreased state in which the pressure in the first container is decreased by the pump; and a third step after the second step of switching the valve on the flow path from the closed state to the opened state under the pressure decreased state while the pump is stopped so as to cause liquid in the second container to be transferred to the first container.

13. The method of stirring liquid according to claim 12, wherein in the third step, liquid in the second container is transferred to the first container by an immediate switch of the valve from the closed state to the opened state under the pressured decreased state.

* * * * *